US006781560B2

(12) United States Patent
Goldstein

(10) Patent No.: US 6,781,560 B2
(45) Date of Patent: Aug. 24, 2004

(54) PHASED ARRAY ANTENNA INCLUDING ARCHIMEDEAN SPIRAL ELEMENT ARRAY AND RELATED METHODS

(75) Inventor: M. Lawrence Goldstein, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 10/060,497

(22) Filed: Jan. 30, 2002

(65) Prior Publication Data

US 2003/0142035 A1 Jul. 31, 2003

(51) Int. Cl.[7] ..... H01Q 1/36
(52) U.S. Cl. ..... 343/895; 343/853
(58) Field of Search ..... 343/895, 893, 343/700 MS, 853; H01Q 1/36

(56) References Cited

U.S. PATENT DOCUMENTS 5,175,561 A * 12/1992 Goto ..... 343/769
5,327,146 A * 7/1994 Jeon ..... 343/700 MS
5,815,122 A * 9/1998 Nurnberger et al. ..... 343/767
5,838,284 A 11/1998 Dougherty ..... 343/893
6,147,657 A 11/2000 Hildebrand et al. ..... 343/844
6,205,224 B1 3/2001 Underbrink ..... 381/92
6,211,841 B1 4/2001 Smith et al. ..... 343/813
6,522,293 B2 * 2/2003 Vail et al. ..... 342/372
6,522,294 B2 * 2/2003 Vail et al. ..... 342/372
6,525,697 B1 * 2/2003 Theobold ..... 343/895

* cited by examiner

*Primary Examiner*—Hoanganh Le
(74) *Attorney, Agent, or Firm*—Allen, Dyer, Doppelt Milbrath & Gilchrist, P.A.

(57) ABSTRACT

A phased array antenna may include a substrate and a plurality of spaced apart phased array antenna elements carried by the substrate and arranged along an imaginary Archimedean spiral. More particularly, the imaginary Archimedean spiral may include a plurality of levels, and a spacing between adjacent pairs of phased array antenna elements along the imaginary Archimedean spiral may be substantially equal to a radial spacing between adjacent levels.

23 Claims, 3 Drawing Sheets

PHASED ARRAY ANTENNA INCLUDING ARCHIMEDEAN SPIRAL ELEMENT ARRAY AND RELATED METHODS

FIELD OF THE INVENTION

The present invention relates to the field of communications, and, more particularly, to phased array antennas and related methods.

BACKGROUND OF THE INVENTION

Antenna systems are widely used in both ground based applications (e.g., cellular antennas) and airborne applications (e.g., airplane or satellite antennas). For example, so-called "smart" antenna systems, such as adaptive or phased array antenna systems, combine the outputs of multiple antenna elements with signal processing capabilities to transmit and/or receive communications signals (e.g., microwave signals, RF signals, etc.). As a result, such antenna systems can vary the transmission or reception pattern (i.e., "beam shaping") or direction (i.e., "beam steering") of the communications signals in response to the signal environment to improve performance characteristics.

As a result of technological advancements and the miniaturization element control circuitry, for example, the density of antenna elements in phased array antennas continues to increase. While significant advantages may be realized by having an increased amount of antenna elements within the same surface area, there are potential drawbacks to grouping a large number of antenna elements too close together.

In particular, when the main signal beam is steered at certain angles, signal side lobes may result with certain antennas. These side lobes may cause undesirable interference with the main signal beam. In certain circumstances, side lobes may even have an intensity or gain equal to that of the main signal beam, which are commonly referred to as "grating lobes", and are particularly problematic.

Attempts have been made in the prior art to reduce high gain side lobes and/or grating lobes in phased array antennas by varying the pattern of the antenna elements. One such approach is to use an aperiodic antenna element array. An example of a phased array antenna having an aperiodic array is disclosed in U.S. Pat. No. 6,147,657 to Hildebrand et al., which is assigned to the assignee of the present application. The antenna elements of the array have an unequally spaced circular distribution which decorrelates angular and linear separations among elements in the array. Without special correlation among the antenna elements of the array, side lobes are advantageously diminished.

While the phased array antenna structure described in the above patent provides a significant advancement in the art, one difficulty in working with aperiodic arrays, for example, is that the design necessarily changes as the number of antenna elements to be used changes. That is, when the number of antenna elements is changed from one design to the next, so too will the angles and relative spacing between the antenna elements change. Accordingly, aperiodic arrays are not easily scalable from one application to the next, and extensive ad hoc or re-design may therefore be required with each new application. Moreover, when using a relatively large number of antenna elements, calculation of the numerous angles and locations that may be required can be quite cumbersome.

Other attempts to reduce side/grating lobes have also been used in the prior art. For example, U.S. Pat. No. 5,838,284 to Dougherty discloses a phased array antenna including antenna elements arranged in the shape of a logarithmic (i.e., equiangular) spiral. While such a design may be less cumbersome to design than an aperiodic array, when such an antenna is used for beam steering it may still suffer from high gain side lobes or even grating lobes at wide scan angles.

Another related example may be found in U.S. Pat. No. 6,205,224 to Underbrink which discloses an array including antenna elements positioned on logarithmic spirals where the spirals intersect a plurality of concentric rings. Yet, while this approach may also help reduce side lobes, it may not be easily scalable from one design to a next where different numbers of antenna elements and varying amounts of surface area are available. Thus, significant design time may still be required with each new antenna array.

SUMMARY OF THE INVENTION

In view of the foregoing background, it is therefore an object of the present invention to provide a phased array antenna having an array which reduces occurrences of grating and/or high gain side lobes yet is relatively easily scalable for numerous applications.

This and other objects, features, and advantages in accordance with the present invention are provided by a phased array antenna which may include a substrate and a plurality of spaced apart phased array antenna elements carried by the substrate and arranged along an imaginary Archimedean spiral. More particularly, the imaginary Archimedean spiral may include a plurality of levels, and a spacing between adjacent pairs of phased array antenna elements along the imaginary Archimedean spiral may be substantially equal to a radial spacing between adjacent levels.

The imaginary Archimedean spiral may be defined by the polar coordinate equation $r=a\theta^N$, where r is a radius, $\theta$ is an angle, and a and N are real numbers, with N preferably being equal to 1. Additionally, the phased array antenna may have an operating wavelength $\lambda$, and a spacing between adjacent pairs of phased array antenna elements may be less than about $10\lambda$. Further, the plurality of phased array antenna elements may have a substantially equal spacing along the imaginary Archimedean spiral, and the substantially equal spacing may also be less than about $10\ \lambda$.

In particular, the plurality of phased array antenna elements may include greater than about 20 phased array antenna elements. Further, substantially all of the plurality of phased array antenna elements may be along the imaginary Archimedean spiral.

The phased array antenna may further include at least one controller for cooperating with the plurality of phased array antenna elements to provide beam steering. For example, the at least one controller may include a plurality of element controllers each connected to at least one of the phased array antenna elements, and a central controller connected to the plurality of element controllers.

A method aspect of the invention is for making the phased array antenna as briefly described above. The method may include providing a substrate and arranging a plurality of phased array antenna elements on the substrate along an imaginary Archimedean spiral. The Archimedean spiral may include a plurality of levels, and arranging may include setting a spacing between adjacent pairs of phased array antenna elements along the imaginary Archimedean spiral to be substantially equal to a radial spacing between adjacent levels.

More particularly, the imaginary Archimedean spiral may be defined by the polar coordinate equation $r=a\theta^N$, where r is a radius, θ is an angle, and a and N are real numbers, with N preferably being equal to 1, as noted above. Furthermore, arranging may include arranging the plurality of phased array antenna elements to have spacing between adjacent pairs thereof of less than about 10λ, for example, where λ is an operating wavelength of the phased array antenna. Moreover, arranging may include arranging the plurality of phased array antenna elements to have a substantially equal spacing along the imaginary Archimedean spiral, which may also be less than about 10λ. A number of the phased array antenna elements may be in a range of about 20 to 200, for example. Also, arranging may include arranging substantially all of the plurality of phased array antenna elements along the imaginary Archimedean spiral.

DETAILED OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
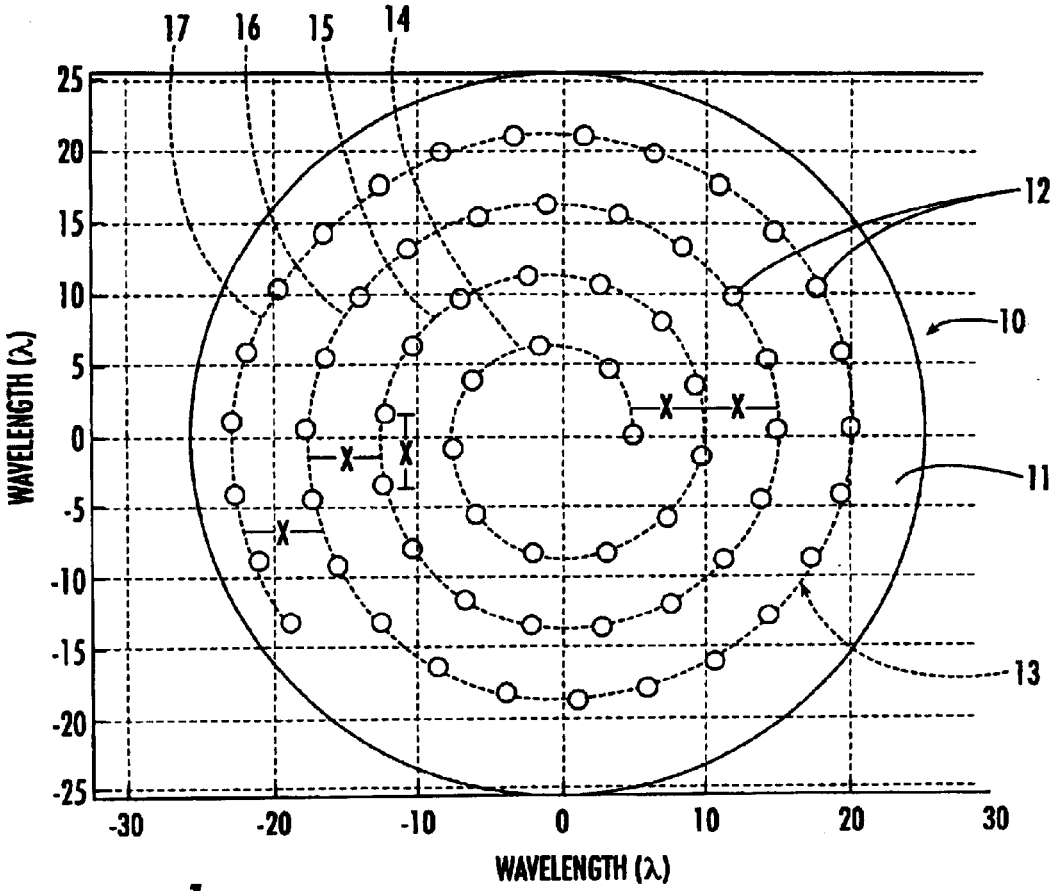
FIG. 1 is schematic plan view of a phased array antenna according to the present invention.

Referring initially to FIG. 1, a phased array antenna 10 includes a substrate 11 and a plurality of spaced apart phased array antenna elements 12 carried by the substrate. As used herein, "substrate" refers to any surface, mechanized structure, etc., which is suitable for carrying a phased array antenna element, as will be appreciated by those of skill in the art. According to the present invention, the antenna elements 12 are advantageously arranged along an imaginary Archimedean spiral 13. More preferably, substantially all of the plurality of phased array antenna elements 12 are along the imaginary Archimedean spiral 13, although other arrangements may be used in some embodiments.

As will be appreciated by those of skill in the art, an Archimedean spiral may be defined by the polar coordinate equation:

$$r=a\theta^N, \quad (1)$$

where r is a radius, θ is an angle, and a and N are real numbers. The particular shape of a given Archimedean spiral is defined by the selection of the number N. For the imaginary Archimedean spiral 13 illustrated in FIG. 1, for example, N is equal to 1, which is also known as an Archimedes spiral. As may be seen, the Archimedes spiral has an equal radial spacing (x in the illustrated example) between levels 14–17 of the imaginary Archimedean spiral 13. The value a determines how tightly wound the spiral is. That is, the value a determines what the spacing x will be, as will be appreciated by those of skill in the art.

This symmetry may be contrasted with the logarithmic spiral used in some prior art antenna arrays, as discussed above. Excepting the special case of a circle where there is only one level, outer levels of a logarithmic spiral are spaced successively radially father apart from one another. Stated alternatively, there is a greater radial distance between outer levels of a logarithmic spiral than between inner levels thereof. Applicant theorizes, without wishing to be bound thereto, that it is this disparity in symmetry between the various levels in a logarithmic spiral element array which may lead to high gain side lobes or even grating lobes at wide scan angles in some applications. Of course, this problem may become particularly acute as larger logarithmic spirals with more levels and antenna elements are used.

The number of levels 14–17 to be used in a particular application will depend upon the surface area available and the number of antenna elements 12, for example. While only four levels 14–17 are illustratively shown in FIG. 1, it will be appreciated that any number of levels may be used in accordance with the present invention. Also, values other than 1 may be used for the number N in equation (1) in accordance with the present invention.

The phased array antenna elements 12 preferably have a substantially equal spacing x along the imaginary Archimedean spiral 13, though unequal spacings may also be used in some embodiments. Moreover, the spacing x between adjacent pairs of phased array antenna elements 12 may be substantially equal to the radial spacing x between adjacent levels. This may be accomplished by setting the value a equal to $x/2\pi$, as will be appreciated by those of skill in the art. It will also be appreciated that this arrangement allows for relatively easy scalability between different antennas in that the design can be fairly quickly modified to include more or less phased array antenna elements 12. Of course, the spacing between adjacent phased array antenna elements 12 and the radial spacing between the levels 14–17 may be different in some embodiments.

Furthermore, a spacing between adjacent pairs of phased array antenna elements 12 may advantageously be scalable to about ten (10) times that of an operating wavelength λ on the phased array antenna 10, or more, in accordance with the present invention. In the exemplary embodiment illustrated in FIG. 1, for example, the spacing x between the phased array antenna elements 12 is 5λ, as may be seen in relation to the wavelength scales provided on the side and bottom of the figure.

Accordingly, the present invention therefore advantageously may be used for arrays where more or less spacing is required between the phased array antenna elements 12 to accommodate the associated transmission/reception circuitry and/or control circuitry thereof, for example. That is, both the radial spacing between the levels 14–17 and the spacing between the phased array antenna elements 12 along the imaginary Archimedean spiral 13 may be scaled to accommodate different applications without the need for extensive ad hoc or re-designing, as will be appreciated by those of skill in the art.

It will therefore also be appreciated that the phased array antenna 10 of the present invention may relatively easily be scaled to include a large number of phased array antenna elements 12. By way of example, a range of greater than about 20 phased array antenna elements 12 may preferably be used, though less phased array antenna elements may potentially be used in some embodiments.

In the embodiment illustrated in FIG. 1, there are 64 phased array antenna elements 12 arranged along the imaginary Archimedean spiral 13. Of course, other phased array antenna elements 12 may be placed at other locations on the substrate 11, such as in the center of the imaginary Archimedean spiral 13 to help increase efficiency in certain embodiments, for example, as will be appreciated by those of skill in the art. Of course, care should be taken to ensure that undesirable side and/or grating lobes do not result from such placement.

Figure 2:
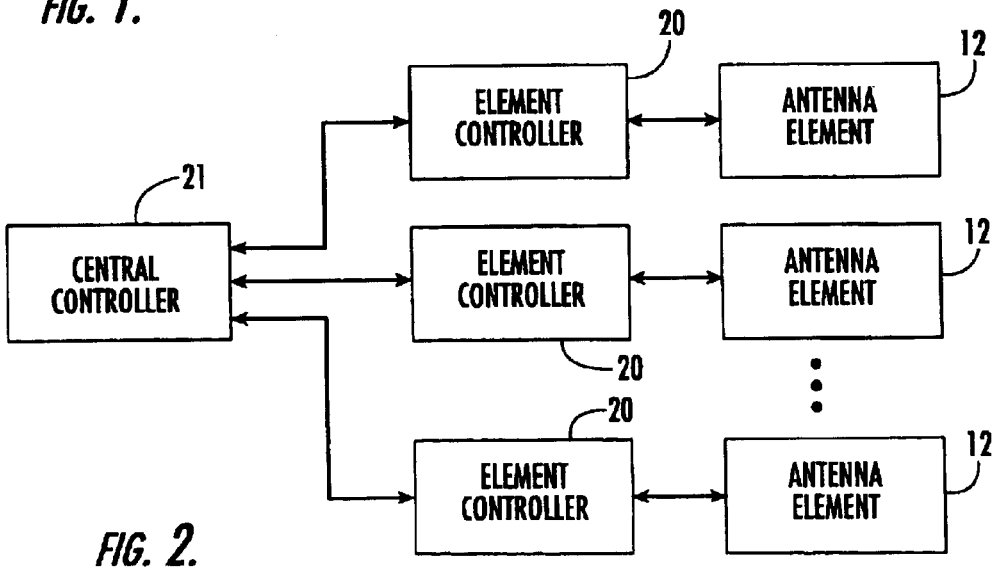
FIG. 2 is schematic block diagram of the phased array antenna of FIG. 1.

Turning now to FIG. 2, the phased array antenna 10 may further include at least one controller for cooperating with the plurality of phased array antenna elements 12 to provide, among other functions, beam steering, as will be appreciated by those of skill in the art. More particularly, the at least one controller may include a plurality of element controllers 20 each connected to at least one of the phased array antenna elements 12, and a central controller 21 connected to the plurality of element controllers.

As illustratively shown in FIG. 2, for example, there is a respective element controller 20 for each phased array antenna element 12, although the element controllers may be used to control more than one phased array antenna element in some embodiments. Furthermore, in embodiments where relatively large numbers of phased array antenna elements 12 are used, additional levels of controllers may also be used (e.g., subarray controllers), as will be appreciated by those of skill in the art. Of course, other controller configurations may also be used.

Figure 3:
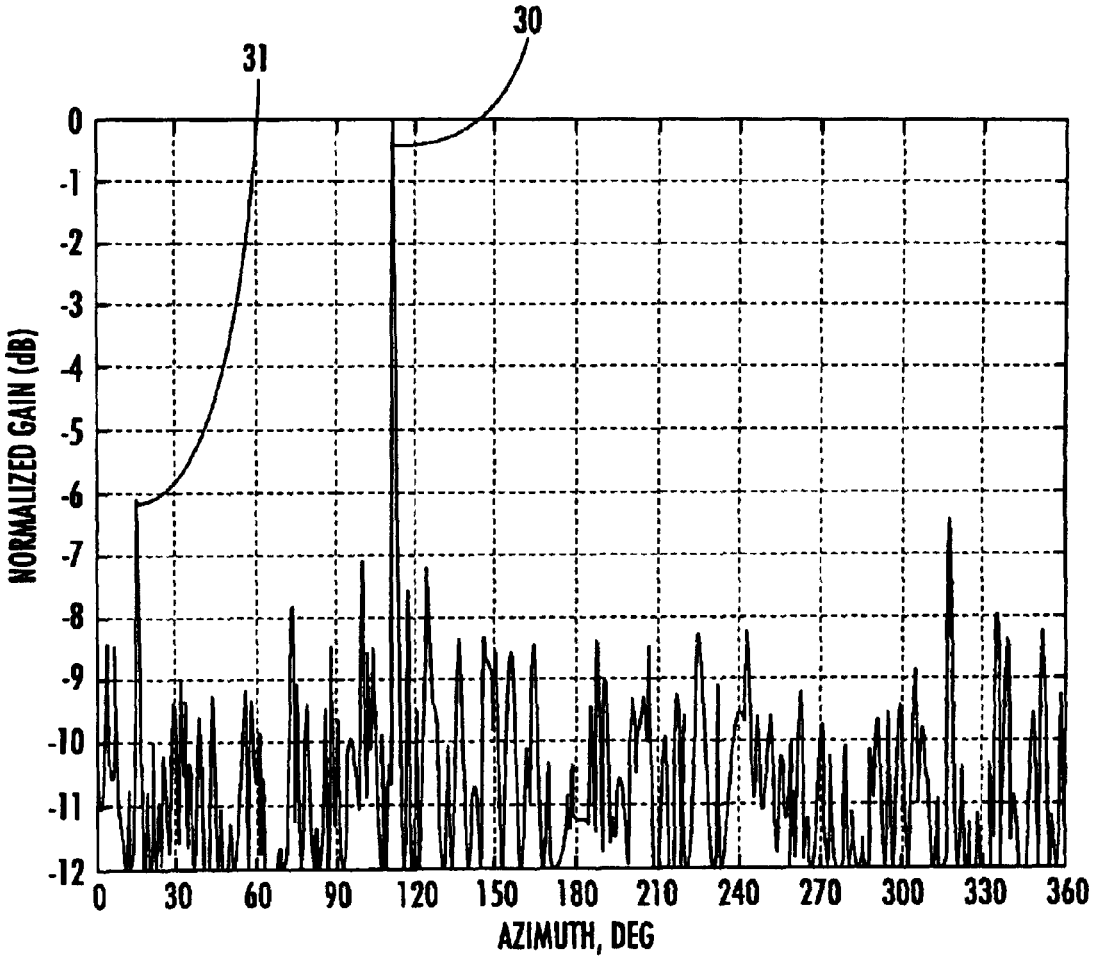
FIG. 3 is graph illustrating normalized gain versus azimuth for a particular beam steering angle using the phased array antenna of FIG. 1.

As noted above, the phased array antenna 10 of the present invention advantageously reduces high gain side lobes, and especially grating lobes, particularly at wide beam angles during beam steering. This will be appreciated further upon examination of the graph of FIG. 3 illustrating gain vs. azimuth for the phased array antenna 10 of FIG. 1. As noted above, 64 phased array antenna elements 12 were used with a 5λ spacing therebetween along the imaginary Archimedean spiral 13. In the example, a main signal beam 30 was scanned across the beam horizon. The highest resulting side lobe 31, which occurred with the main signal beam 30 steered to 111° azimuth, 90° elevation (angle from boresight) with a gain of 0 dB, was at 15.6° azimuth, 36.9° elevation, with a gain of −6.09 dB.

Figure 4:
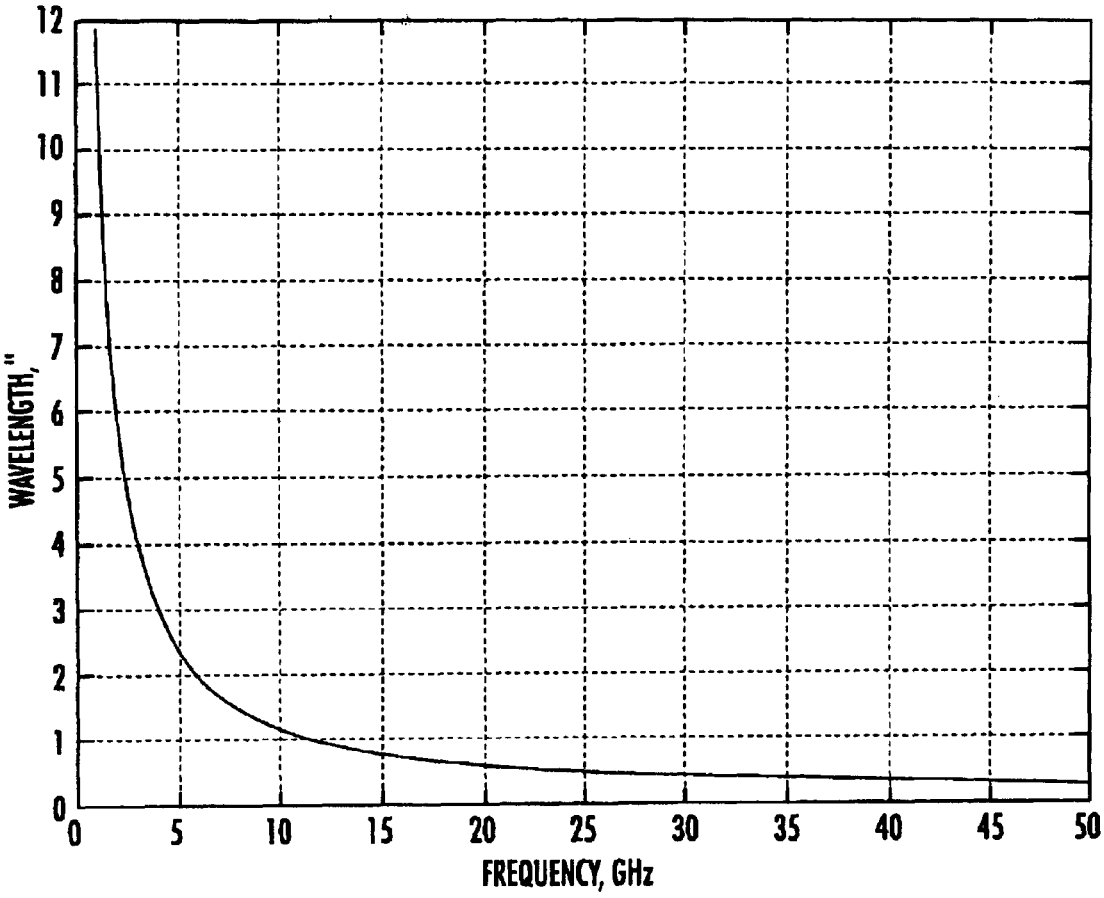
FIG. 4 is a graph illustrating frequency response for various antenna element spacings for a phased array antenna according to the present invention.

Accordingly, the present invention advantageously provides for relatively easy scalability between various phased array antenna designs without the need for extensive ad hoc or re-design. In addition, because of the ease of scalability, relatively large (or small) spacings of up to 10λ or more may be provided between the phased array antenna elements 12 to accommodate more (or less) transmission/reception and/or control circuitry. A graph illustrating the advantageous frequency characteristics provided according to the present invention with respect to various wavelength spacings is illustratively shown in FIG. 4.

A method aspect of the present invention is for making a phased array antenna 10 as described above. The method may include providing a substrate 11 and arranging a plurality of phased array antenna elements 11 on the substrate along an imaginary Archimedean spiral 13. The Archimedean spiral may include a plurality of levels 14–17, and arranging may include setting a spacing x between adjacent pairs of phased array antenna elements 12 to be substantially equal to a radial spacing x between adjacent levels.

More particularly, the imaginary Archimedean spiral 13 may be defined by the polar coordinate equation $r=a\theta^N$, where r is a radius, θ is an angle, and a and N are real numbers, with N preferably being equal to 1, as noted above. Furthermore, arranging may include arranging the plurality of phased array antenna elements 12 to have a substantially equal spacing x along the imaginary Archimedean spiral, which may be less than about 10λ, for example. A number of the phased array antenna elements 12 may be greater than about 20, as also noted above. Of course, arranging may include arranging each of the plurality of phased array antenna elements 12 on the substrate 11 and on the imaginary Archimedean spiral 13.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

What is claimed is:

1. A phased array antenna comprising:

a substrate;

a plurality of spaced apart phased array antenna elements carried by said substrate and arranged along an imaginary Archimedean spiral; and at least one controller cooperating with said plurality of phased array antenna elements to provide beam steering.

2. The phased array antenna of claim 1 wherein the imaginary Archimedean spiral comprises a plurality of levels.

3. The phased array antenna of claim 2 wherein a spacing between adjacent pairs of phased array antenna elements along the imaginary Archimedean spiral is substantially equal to a radial spacing between adjacent levels.

4. The phased array antenna of claim 1 wherein the imaginary Archimedean spiral is defined by the polar coordinate equation $r=a\theta^N$, where r is a radius, θ is an angle, a is a real number, and N=1.

5. The phased array antenna of claim 1 wherein said plurality of phased array antenna elements have a substantially equal spacing along the imaginary Archimedean spiral.

6. The phased array antenna of claim 5 wherein the phased array antenna has an operating wavelength λ, and wherein the substantially equal spacing is less than about 10λ.

7. The phased array antenna of claim 1 wherein the phased array antenna has an operating wavelength λ, and wherein a spacing between adjacent pairs of phased array antenna elements is less than about 10λ.

8. The phased array antenna of claim 1 wherein said plurality of phased array antenna elements comprises greater than about 20 phased array antenna elements.

9. The phased array antenna of claim 1 wherein said at least one controller comprises:

a plurality of element controllers each connected to at least one of said phased array antenna elements; and a central controller connected to said plurality of element controllers.

10. The phased array antenna of claim 1 wherein substantially all of the plurality of phased array antenna elements of the phased array antenna are along the imaginary Archimedean spiral.

11. A phased array antenna comprising:

a substrate;

a plurality of spaced apart phased array antenna elements on said substrate, substantially all of said phased array antenna elements being arranged along an imaginary Archimedean spiral comprising a plurality of levels, a spacing between adjacent pairs of phased array antenna elements along the imaginary Archimedean spiral being substantially equal to a radial spacing between adjacent levels; and at least one controller for cooperating with said plurality of phased array antenna elements to provide beam steering.

12. The phased array antenna of claim 11 wherein the imaginary Archimedean spiral is defined by the polar coordinate equation $r=a\theta^N$, where r is a radius, θ is an angle, a is a real number, and N=1.

13. The phased array antenna of claim 11 wherein the phased array antenna has an operating wavelength λ, and wherein the spacing between adjacent pairs of phased array antenna elements is less than about 10λ.

14. The phased array antenna of claim 11 wherein said plurality of phased array antenna elements comprises greater than about 20 phased array antenna elements.

15. The phased array antenna of claim 11 wherein said at least one controller comprises:

a plurality of element controllers each connected to at least one of said phased array antenna elements; and a central controller connected to said plurality of element controllers.

16. A method for making a phased array antenna comprising:

providing a substrate;

arranging a plurality of phased array antenna elements on the substrate along an imaginary Archimedean spiral; and providing at least one controller for cooperating with the plurality of phased array antenna elements to provide beam steering.

17. The method of claim 16 wherein the Archimedean spiral comprises a plurality of levels.

18. The method of claim 17 wherein arranging comprises setting a spacing between adjacent pairs of phased array antenna elements along the imaginary Archimedean spiral to be substantially equal to a radial spacing between adjacent levels.

19. The method of claim 16 wherein the imaginary Archimedean spiral is defined by the polar coordinate equation $r=a\theta^N$, where r is a radius, θ is an angle, a is a real number, and N=1.

20. The method of claim 16 wherein arranging comprises arranging substantially all of the plurality of phased array antenna elements of the phased array antenna to have a substantially equal spacing along the imaginary Archimedean spiral.

21. The method of claim 20 wherein the phased array antenna has an operating wavelength λ, and wherein the substantially equal spacing is less than about 10λ.

22. The method of claim 16 wherein the phased array antenna has an operating wavelength λ, and wherein arranging comprises setting a spacing between adjacent pairs of phased array antenna elements to be less than about 10λ.

23. The method of claim 16 wherein the plurality of phased array antenna elements comprises greater than about 20 phased array antenna elements.

* * * * *